United States Patent [19]

Burton

[11] Patent Number: 4,863,664

[45] Date of Patent: Sep. 5, 1989

[54] HIGH SPEED PROCESS OF MAKING POLYAMIDE FILAMENTS

[75] Inventor: Wendel L. Burton, Anderson, S.C.

[73] Assignee: BASF Corporation, Williamsburg, Va.

[21] Appl. No.: 51,266

[22] Filed: May 5, 1987

Related U.S. Application Data

[63] Continuation of Ser. No. 725,864, Apr. 22, 1985, abandoned.

[51] Int. Cl.[4] ..... D01F 1/02

[52] U.S. Cl. ..... 264/210.6; 264/210.8; 264/211; 264/211.14

[58] Field of Search ..... 524/386; 264/211, DIG. 56, 264/210.6, 210.8, 211.14

[56] References Cited

U.S. PATENT DOCUMENTS

| | | | |
|---|---|---|---|
| 2,615,002 | 10/1952 | Hurwitz | 524/386 |
| 2,743,350 | 7/1960 | Roderacker | 264/85 |
| 3,093,445 | 6/1963 | Freeman | 264/D56 |
| 3,182,100 | 5/1965 | Bedell | 264/D56 |
| 3,388,029 | 6/1968 | Bugnac | 524/386 |
| 3,549,651 | 12/1970 | Opwald et al. | 524/386 |
| 4,049,766 | 9/1977 | Eskridge et al. | 264/210.3 |
| 4,301,105 | 11/1981 | Coleman et al. | 264/211 |
| 4,301,106 | 11/1981 | Coleman et al. | 264/211 |
| 4,592,468 | 5/1986 | Follows et al. | 264/211 |

FOREIGN PATENT DOCUMENTS

| | | | |
|---|---|---|---|
| 0458393 | 7/1949 | Canada | 264/211 |
| 40-1050365 | 5/1965 | Japan . | |
| 47-46601 | 11/1972 | Japan | 264/211 |
| 48-13737 | 4/1973 | Japan | 264/211 |
| 52-112477 | 1/1977 | Japan . | |
| 52-4291677 | 4/1977 | Japan . | |
| 55-3444 | 1/1980 | Japan | 264/211 |
| 55-2626980 | 2/1980 | Japan . | |
| 58-2208583 | 1/1984 | Japan . | |

*Primary Examiner*—Hubert Lorin

*Attorney, Agent, or Firm*—Edward F. Sherer; Rupert B. Hurley, Jr.

[57] ABSTRACT

A high speed process for producing polyamide filaments utilizing one or more melt additives selected from the group consisting of water, alcohols, and organic acids to form a homogeneous polyamide-additive mixture so that upon extrusion of the mixture the polyamide has a relative viscosity in the range of from about 2.0 to about 3.0, melt-extruding the mixture to form filaments, quenching and drawing the filaments, and taking up the filaments at a speed greater than 4000 mpm. The process improves package build, yarn quality, and yarn processing conditions, and enables low elongations, high tenacity, and higher production speeds.

9 Claims, 4 Drawing Sheets

KEY for FIGS. 4 - 6

| | CHIP | DRAW | ADDITIVE | DEN/FIL |
|---|---|---|---|---|
| • | B300 | 1.0 | NONE | 3.3 |
| △ | B300 | 1.0 | $H_2O$ | 3.3 |
| ○ | B216 | 1.0 | $H_2O$ | 3.3 |
| × | B216 | 1.0 | $H_2O$ | 1.4 |

KEY for FIGS. 7&8

| | CHIP | DRAW | ADDITIVE | DEN/FIL | TAKE UP SPEED |
|---|---|---|---|---|---|
| • | B300 | 1.0 | $H_2O$ | 3.3 | — |
| ∘ | B216 | 1.0 | $H_2O$ | 3.3 | 5000 |

HIGH SPEED PROCESS OF MAKING POLYAMIDE FILAMENTS

This is a continuation of application Ser. No. 725,864 filed on Apr. 22, 1985, now abandoned.

BACKGROUND OF THE INVENTION

1. Field of the Invention

The present invention is concerned with an improved high speed process of making polyamide filaments wherein an additive selected from the group consisting of water, alcohols, and organic acids is added to a polymer, wherein the additive has a molecular weight of less than 400.

The present invention is classified in the area of synthetic resins, more particularly in the area of processes of preparing a desired or intentional composition of at least one nonreactant material and at least one solid polymer or specified intermediate condensation product, or product thereof, wherein the nonreactant material is added to the solid polymer. Within this main area, art related to the present invention may be found among organic nonreactant materials in which a carbon atom is singly bonded to an oxygen atom and wherein there is either: (a) only a single C- OH group and at least six carbon atoms or (b) at least two- OH groups. Also within this main area, related art may be found within the area in which the polymer is derived from ethylenic, nitrogen-containing reactants only wherein water is the nonreactant material.

2. Description of the Prior Art

Applicant has located several prior art U.S. patents which are related to the present invention, including U.S. Pat. No. 3,182,100; U.S. Pat. No. 3,093,445; U.S. Pat. No. 2,615,002; U.S. Pat. No. 2,943,350; U.S. Pat. No. 4,049,766; U.S. Pat. No. 3,549,651; and U.S. Pat. No. 3,388,029. Applicant has also located several journal articles related to the nonobviousness of the present invention, including:

(a) V. S. Shirshin, V. Vais, et al., *Effect of Polycaproamide Transport and Storage Conditions on Change in its Qualitative Indices,* copyright 1984 Plenum Publishing Corporation, pp. 398–401.

(b) M. I. Kohan, Nylon Plastics, J. Wiley & Sons, copyright 1973, pp. 210 and 427–428.

The U.S. patents referred to above pertain to a material which is either residual or added to the polymer. However, non of these patents refer to high speed processes, i.e., processes in which the yarn is traveling at a speed which is greater than 3200 meters per minute. As is shown in the examples below, the effects of melt additives are opposite when comparing high and low speed processes.

The articles referred to above (a and b) teach that in high speed processes, the nylon polymer should contain as little water as possible. This is contrary to the present invention. The advent of high speed spinning technology has been relatively recent, and teachings related to production speeds versus polymer content are very rare in the high speed area.

BRIEF SUMMARY OF THE INVENTION

The present invention is concerned with an improved high speed process for the production of polyamide filaments, especially filaments of textile quality. The process is carried out by adding one or more members of a selected group of additives consisting of water, alcohols, and organic acids to the polyamide in order to improve package build, yarn quality, and yarn processing conditions. For example, it has been found that less package deformation occurs under the instant process. Furthermore, low elongation and increased tenacity are possible, among other product improvements, by utilizing the instant process. Finally, higher yarn production speeds are possible utilizing the instant process.

The improved process comprises the steps of:

(a) Mixing the additive into the polyamide in order to form a mix; and (b) Extruding the mix to form filaments; and (c) Quenching the filaments; and (d) Taking up the filaments at high speed.

In the improved process, the additive must be thoroughly mixed so that a homogeneous mix is formed. It has been conceived that the additive may be added in any amount so long as a resulting molten polymer mix has a relative viscosity between 2.0 and 3.0 preferably between 2.2 and 2.6. Since polyamides are hydroscopic and water is generally present to some degree prior to spinning, water is only considered to be an "additive" if it is present in an amount greater than 0.15% by weight.

It is an object of the present invention to enable an improved high speed melt spinning process for polyamides.

It is a further object of the present invention to enable higher speeds for the melt spinning of polyamide textile filaments.

It is a further object of the present invention to improve package build in the high speed melt spinning of polyamide textile filaments with a denier per filament, preferably of less than 12, more preferably of less than 3.5.

It is a further object of the present invention to prevent tube crushing without heat relaxation of the yarn in a high speed polyamide melt spinning process.

It is a further object of the present invention to utilize additives in order to improve the high speed melt spinning of polyamides.

It is a further object of the present invention to enable one to simultaneously lower the elongation and increase the modulus of polyamide textile filaments.

It is a further object of the present invention to enable improved washfastness and dye uniformity of polyamide filaments made with high speed melt spinning processes.

It is a further object of the present invention to utilize additives in a high speed spin-draw-wind process for the manufacture of polyamide filaments.

It is a further object of the present invention to achieve acceptable tensile properties at low draw ratios.

It is a further object of the preent invention to lower the relative viscosity of the melt by adding an additive, followed by spinning a yarn with lower elongation than would have occurred had the additive not been added, all other conditions remaining the same.

It is a further object of the present invention to enable one to increase the take-up speed (without experiencing tube crushing) by at least 1200 meters per minute with respect to the speed at which tube crushing begins to occur without additives.

It is a further object of the present invention to enable one to obtain a higher modulus and lower elongation product at processing speeds slower than one would obtain in a process identical except without additives.

DETAILED DESCRIPTION OF THE PREFERRED EMBODIMENTS

Figure 1:
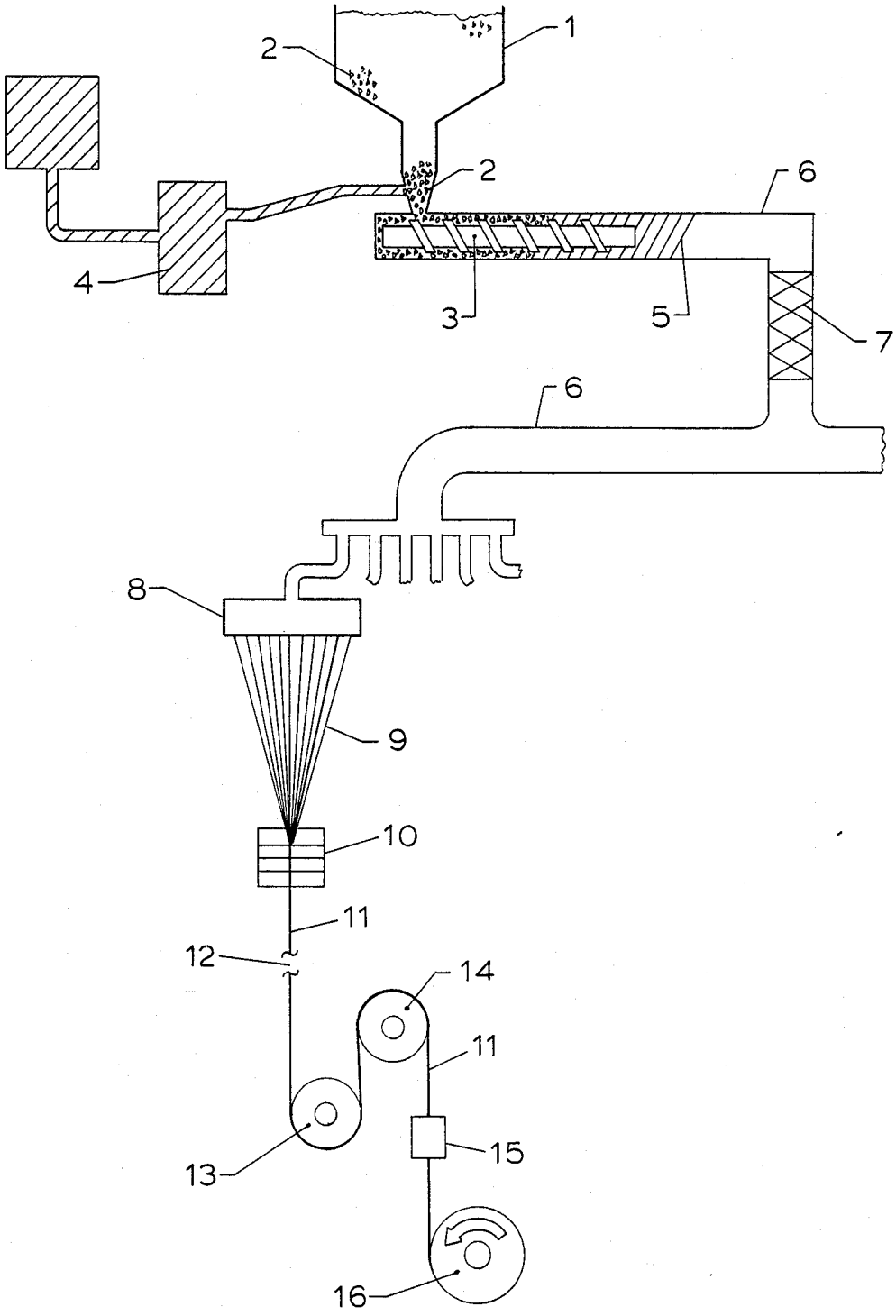
FIG. 1 illustrates the process of the present invention as it appears downstream of, and including, the chip hopper.

The present process is concerned with adding water, alcohols, and/or organic acids to polyamides in order to improve the resulting textile product and/or processing in a high speed filament production operation. It has been unexpectedly found that in high speed polyamide filament production, water, alcohols, and organic acids have a beneficial effect on the melt if they are added in limited amounts and for limited times so that the resulting polymer mix has a relative viscosity (as measured in 96% sulfuric acid) between 2.0 and 3.0. Classical theory (e.g. U.S. Pat. No. 3,475,368) states that addition of plasticizers to a polymer will result in an increase in the elongation and a decrease in both the modulus and breaking strength. However, it has been unexpectedly discovered that the opposite occurs in high speed melt spinning processes for polyamides, i.e. the addition of one or more of the additives recited above to the polymer prior to a high speed extrusion process will improve the tensile properties, i.e. raise the modulus and lower the elongation. In high speed spin draw processes for the production of polyamide textile filaments, there has been a problem with tube crushing as the yarn puts great force on the tube, causing it to collapse on the winder chuck, making it impossible to remove the tube from the winder without destroying the yarn package thereon. The use of additives has been found to relieve the tube crushing problem by reducing the build up of the yarn stresses which cause tube crushing.

It has been demonstrated that the use of the additives of the present invention will allow one to obtain beneficial extensions of processing speeds in the production of polyamide filaments. For example, since the use of additives lowers the relative viscosity while simultaneously creating package relaxation (as shown in FIGS. 4–8), the use of additives can allow one to increase the take up speed by at least 1200 meters per minute (without tube crushing) with respect to the speed at which tube crushing begins to occur without additives. Furthermore, since the use of additives lowers the elongation and elevates the modulus of the product, the use of additives will allow one to obtain a product having similar characteristics at lower processing speeds.

In a preferred process of the present invention, a polycaprolactam polymer chip has an additive thoroughly mixed therewith followed by melting (in a screw extruder) and extrusion through a spinnerette, forming a plurality of molten polycaprolactam filaments. The molten polycaprolactam filaments are then quenched. After quenching the filaments are coalesced and simultaneously have finish applied thereto by a finish metering device. Generally, the coalesced filaments are then drawn between 1.02x and 3.0x, preferably between 1.02x and 1.8x, or more preferably between 1.02x and 1.45x, followed by air jet entanglement. However, it is not absolutely necessary to draw the filaments. The filaments are then wound.

The process of the present invention is preferably carried out in a high speed spin-draw-wind process, wherein the fastest traveling surface is moving at a speed of at least 3200 meters per minute. Generally, the fastest traveling surface is the downstream draw godet, as the yarn is drawn between the first and second godet, and is then relaxed between the second godet and the winder.

In this preferred process, the polymer mix is extruded through a spinnerette, quenched, has finish applied thereto, is drawn by partial wrap on two godets, and is then wound on a bobbin. Most preferably, the yarn is interlaced after drawing.

FIG. 1 illustrates the process of the present invention as it appears downstream of, and including, the chip hopper. The chip hopper (1) is supplied with chip (2). The hopper (1) in turn supplies the extruder (3) throat with chip (2). An additive pump (4) is shown simultaneously supplying the extruder throat with a liquid additive, this process being carried out by simply dripping the liquid onto the chip stream which is entering the extruder (3). Once the chip exits the extruder as a molten stream (5), the stream is pumped through a conduit (6) which contains a plurality of static mixers (7). Once through the static mixers (7), the mix stream enters the spinnerette (8) and is extruded into a plurality of molten streams (9) which are solidified in a quench zone and are then coalesced and simultaneously have finish applied by a finish applicator (10). The coalesced filaments (11) then travel downward through an interfloor tube, schematically indicated by the "break" (12). The yarn next travels around a first (upstream) powered godet (13) and then around a second (downstream) powered godet (14), following which the yarn (11) is interlaced by an interlacer (15). Lastly, the yarn is wound into a bobbin (16).

The yarn may be drawn by being passed over two or more godets which travel at different surface speeds, i.e., the surface speed of the downstream godet being at least two percent higher than the surface speed of the upstream godet.

Table I, containing examples 1 through 86, pertains to processes carried out using the preferred apparatus as described above. As can be seen from these examples, the relative viscosity of the polymer dropped with increasing amounts of additive, but unexpectedly the elongation decreased. These examples show that the improved process is operable for different polyamide polymers. These polymers, coded as B300, B216, etc. are described below in detail in Table II.

TABLE II

| TiO (%) | DESIGNATED CHIP TYPE | CHEMICAL SPECIES | POLYMERS USED IN EXAMPLES RELATIVE VISCOSITY | AMINO END GROUPS (meg/kg) | CARBOXYLIC END GROUPS (meg/kg) | METHANOL EXTRACTABLES (%) | $H_2O$ (%) |
|---|---|---|---|---|---|---|---|
| 1 | B300 | polycaprolactam | 2.75 | 34 | 55 | 0.42 | |
| 1.6 | B216 | polycaprolactam | 2.36 | 29.5 | 67.8 | 0.44 | .08 |
| 0.009 | B3S | polycaprolactam | 2.61 | 54.6 | 55.6 | | .09 |
| 0.008 | B35 | polycaprolactam | 3.2 | 38.5 | 31.7 | 1.0 | |
| 0.298 | AS503 | polyhexamethylene adipimide | 2.51 | 49.9 | | | |

The additives utilized in Table I have been specifically chosen in order to illustrate that the process is operable for a variety of additives, including water, alcohols, and organic acids. The results of these examples are reported below in Table I.

TABLE I

| EXAMPLE # | ADDITIVE TYPE | ADDITIVE AMOUNT | RV | % ELONGATION | L-10 (gms) | DRAW RATIO | WINDER SPEED (M/MIN) | CHIP TYPE | FILAMENT TYPE |
|---|---|---|---|---|---|---|---|---|---|
| 1 | CONTROL | 0 | 2.79 | 69 | 40 | 1.05 | 4750 | B300 | 40/12R |
| 2 | $H_2O$ | 0.5% | 2.61 | 63 | 44 | 1.05 | 4750 | B300 | 40/12R |
| 3 | $H_2O$ | 1.0% | 2.42 | 55 | 50 | 1.05 | 4750 | B300 | 40/12R |
| 4 | $H_2O$ | 1.5% | 2.24 | 51 | 55 | 1.05 | 4750 | B300 | 40/12R |
| 5 | CONTROL | 0 | 2.72 | 70 | 37 | 1.05 | 4750 | B300 | 40/12R |
| 6 | Benzyl Alcohol | 1% | 2.65 | 63 | 39 | 1.05 | 4750 | B300 | 40/12R |
| 7 | Benzyl Alcohol | 2% | 2.52 | 57 | 45 | 1.05 | 4750 | B300 | 40/12R |
| 8 | Benzyl Alcohol | 3% | 2.40 | 56 | 49 | 1.05 | 4750 | B300 | 40/12R |
| 9 | Benzyl Alcohol | 4% | 2.37 | 50 | 53 | 1.05 | 4750 | B300 | 40/12R |
| 10 | CONTROL | 0 | 2.75 | 68 | 37 | 1.05 | 4750 | B300 | 40/12R |
| 11 | Triethylenegylcol | 0.5% | 2.65 | 66 | 44 | 1.05 | 4750 | B300 | 40/12R |
| 12 | Triethyleneglycol | 1.0% | 2.59 | 62 | 48 | 1.05 | 4750 | B300 | 40/12R |
| 13 | Triethyleneglycol | 2.0% | 2.42 | 58 | 51 | 1.05 | 4750 | B300 | 40/12R |
| 14 | Triethyleneglycol | 3.0% | 2.40 | 54 | 53 | 1.05 | 4750 | B300 | 40/12R |
| 15 | Pentaerythritol | 1.0% | 2.45 | 56 | 52 | 1.05 | 4750 | B300 | 40/12R |
| 16 | Pentaerythritol | 2.0% | 2.27 | 54 | 58 | 1.05 | 4750 | B300 | 40/12R |
| 17 | Benzoin | 3.2% | 2.31 | 55 | 54 | 1.05 | 4750 | B300 | 40/12R |
| 18 | Benzoin | 4.9% | 2.24 | 51 | 54 | 1.05 | 4750 | B300 | 40/12R |
| 19 | Chlorobenzoic acid | 0.5% | 2.50 | 61 | 45 | 1.05 | 4750 | B300 | 40/12R |
| 20 | Lauric Acid | 0.7% | 2.25 | 55 | 55 | 1.05 | 4750 | B300 | 40/12R |
| 21 | CONTROL | 0 | 3.0 | 51 | 71 | 1.30 | 4750 | B35 | 40/12R |
| 22 | Benzyl Alcohol | 1.0% | N/A | 49 | 73 | 1.30 | 4750 | B35 | 40/12R |
| 23 | Benzyl Alcohol | 3.0% | 2.7 | 41 | 88 | 1.30 | 4750 | B35 | 40/12R |
| 24 | Benzyl Alcohol | 5.0% | 2.4 | 31 | 95 | 1.30 | 4750 | B35 | 40/12R |
| 25 | Benzyl Alcohol | 7.0% | 2.36 | 30 | 99 | 1.30 | 4750 | B35 | 40/12R |
| 26 | CONTROL | 0 | 3.3 | 49 | 73 | 1.30 | 4750 | B35 | 40/12R |
| 27 | $H_2O$ | 0.75% | 2.9 | 46 | 82 | 1.30 | 4750 | B35 | 40/12R |
| 28 | $H_2O$ | 1.5% | 2.7 | 42 | 89 | 1.30 | 4750 | B35 | 40/12R |
| 29 | $H_2O$ | 1.8% | 2.6 | 39 | 96 | 1.30 | 4750 | B35 | 40/12R |
| 30 | $H_2O$ | N/A | 2.5 | 37 | 96 | 1.30 | 4750 | B35 | 40/12R |
| 31 | CONTROL | 0 | 2.31 | 54 | 49 | 1.05 | 4750 | B3S | 40/12R |
| 32 | $H_2O$ | 1.0% | 2.14 | 50 | 51 | 1.05 | 4750 | B3S | 40/12R |
| 33 | CONTROL | 0 | 2.31 | 45 | 77 | 1.20 | 4750 | B3S | 40/12R |
| 34 | $H_2O$ | 1.0% | 2.14 | 36 | 84 | 1.20 | 4750 | B3S | 40/12R |
| 35 | CONTROL | 0 | 2.48 | 71 | 35 | 1.05 | 4750 | AS503 | 40/12R |
| 36 | Triethylene glycol | 0.75% | 2.30 | 65 | 37 | 1.05 | 4750 | AS503 | 40/12R |
| 37 | CONTROL | 0 | 2.37 | 62 | 41 | 1.00 | 5000 | B216 | 40/12R |
| 38 | $H_2O$ | 0.25% | 2.36 | 59 | 45 | 1.00 | 5000 | B216 | 40/12R |
| 39 | $H_2O$ | 0.34% | 2.29 | 59 | 46 | 1.00 | 5000 | B216 | 40/12R |
| 40 | $H_2O$ | 0.47% | 2.26 | 56 | 46 | 1.00 | 5000 | B216 | 40/12R |
| 41 | CONTROL | 0 | 2.43 | 60 | 42 | 1.00 | 5000 | B216 | 40/28T |
| 42 | $H_2O$ | 0.48% | 2.26 | 57 | 45 | 1.00 | 5000 | B216 | 40/28T |
| 43 | $H_2O$ | 0.75% | 2.20 | 52 | 47 | 1.00 | 5000 | B216 | 40/28T |
| 44 | $H_2O$ | 0.98% | 2.13 | 53 | 48 | 1.00 | 5000 | B216 | 40/28T |
| 45 | CONTROL | 0 | 2.36 | 58 | 45 | 1.00 | 5350 | B216 | 40/28T |
| 46 | $H_2O$ | 0.48% | 2.30 | 56 | 45 | 1.00 | 5250 | B216 | 40/28T |
| 47 | CONTROL | 0 | 2.78 | 59 | 51 | 1.14 | 4300 | B300 | 40/12R |
| 48 | $H_2O$ | 0.5% | 2.66 | 54 | 59 | 1.14 | 4300 | B300 | 40/12R |
| 49 | $H_2O$ | 1.0% | 2.53 | 51 | 64 | 1.14 | 4300 | B300 | 40/12R |
| 50 | $H_2O$ | 1.5% | 2.46 | 51 | 64 | 1.14 | 4300 | B300 | 40/12R |
| 51 | CONTROL | 0 | 2.78 | 59 | 51 | 1.14 | 4300 | B300 | 40/12R |
| 52 | Triethylene glycol | 1.0% | 2.55 | 53 | 58 | 1.14 | 4300 | B300 | 40/12R |
| 53 | Triethylyene glycol | 2.0% | 2.53 | 52 | 63 | 1.14 | 4300 | B300 | 40/12R |
| 54 | Triethylene glycol | 3.0% | 2.45 | 49 | 63 | 1.14 | 4300 | B300 | 40/12R |
| 55 | CONTROL | 0 | 2.60 | 45 | 85 | 1.20 | 5660 | B300 | 40/12R |

TABLE I-continued

| EXAMPLE # | ADDITIVE TYPE | ADDITIVE AMOUNT | RV | % ELONGATION | L-10 (gms) | DRAW RATIO | WINDER SPEED (M/MIN) | CHIP TYPE | FILAMENT TYPE |
|---|---|---|---|---|---|---|---|---|---|
| 56 | $H_2O$ | 0.5% | 2.54 | 38 | 102 | 1.20 | 5660 | B300 | 40/12R |
| 57 | $H_2O$ | 0.75% | 2.47 | 35 | 118 | 1.20 | 5660 | B300 | 40/12R |
| 58 | Benzyl Alcohol | 4.2% | 2.42 | 36 | 112 | 1.30 | 4750 | B300 | 40/12R |
| 59 | Benzyl Alcohol | 4.2% | 2.42 | 23 | 136 | 1.45 | 4750 | B300 | 40/12R |
| 60 | CONTROL | 0 | 2.75 | 63 | 42 | 1.00 | 5250 | B300 | 40/12R |
| 61 | $H_2O$ | 1.0% | 2.31 | 54 | 50 | 1.00 | 5250 | B300 | 40/12R |
| 62 | CONTROL | 0 | 2.74 | 70 | 37 | 1.00 | 4000 | B300 | 40/12R |
| 63 | $H_2O$ | 0.21% | 2.61 | 67 | 39 | 1.00 | 4000 | B300 | 40/12R |
| 64 | $H_2O$ | 0.24% | N/A | 63 | 43 | 1.00 | 4000 | B300 | 40/12R |
| 65 | $H_2O$ | 0.39% | 2.48 | 62 | 47 | 1.00 | 4000 | B300 | 40/12R |
| 66 | $H_2O$ | 0.50% | 2.42 | 62 | 47 | 1.00 | 4000 | B300 | 40/12R |
| 67 | $H_2O$ | 0.56% | 2.40 | 59 | 52 | 1.00 | 4000 | B300 | 40/12R |
| 68 | $H_2O$ | 0.98% | 2.31 | 61 | 45 | 1.00 | 4000 | B300 | 40/12R |
| 69 | $H_2O$ | 1.50% | 2.22 | expands off bobbin | | 1.00 | 4000 | B300 | 40/12R |
| 70 | CONTROL | 0 | 2.74 | 66 | 45 | 1.07 | 4000 | B300 | 40/12R |
| 71 | $H_2O$ | 0.21% | 2.61 | 61 | 52 | 1.07 | 4000 | B300 | 40/12R |
| 72 | $H_2O$ | 0.24% | N/A | 60 | 54 | 1.07 | 4000 | B300 | 40/12R |
| 73 | $H_2O$ | 0.39% | 2.48 | 57 | 56 | 1.07 | 4000 | B300 | 40/12R |
| 74 | $H_2O$ | 0.50% | 2.42 | 59 | 57 | 1.07 | 4000 | B300 | 40/12R |
| 75 | $H_2O$ | 0.56% | 2.40 | 57 | 55 | 1.07 | 4000 | B300 | 40/12R |
| 76 | $H_2O$ | 0.98% | 2.31 | 60 | 52 | 1.07 | 4000 | B300 | 40/12R |
| 77 | $H_2O$ | 1.50% | 2.22 | 59 | 49 | 1.07 | 4000 | B300 | 40/12R |
| 78 | $H_2O$ | 1.68% | 2.18 | 57 | 48 | 1.07 | 4000 | B300 | 40/12R |
| 79 | CONTROL | 0 | 2.74 | 61 | 52 | 1.13 | 4000 | B300 | 40/12R |
| 80 | $H_2O$ | 0.21% | 2.61 | 59 | 56 | 1.13 | 4000 | B300 | 40/12R |
| 81 | $H_2O$ | 0.24% | N/A | 57 | 59 | 1.13 | 4000 | B300 | 40/12R |
| 82 | $H_2O$ | 0.39% | 2.48 | 58 | 58 | 1.13 | 4000 | B300 | 40/12R |
| 83 | $H_2O$ | 0.50% | 2.42 | 57 | 59 | 1.13 | 4000 | B300 | 40/12R |
| 84 | $H_2O$ | 0.56% | 2.40 | 55 | 61 | 1.13 | 4000 | B300 | 40/12R |
| 85 | $H_2O$ | 0.98% | 2.31 | 56 | 56 | 1.13 | 4000 | B300 | 40/12R |
| 86 | $H_2O$ | 1.50% | 2.22 | 60 | 49 | 1.13 | 4000 | B300 | 40/12R |

The data presented in Table I illustrates the process of the present invention when the additive is water, a primary alcohol, a secondary alcohol, a diol, a tetraol, an aliphatic acid, or an aromatic acid. Furthermore, these examples indicate that the invention is operable for a variety of winding speeds, draw ratios, and filament types and sizes. Note that in every instance the elongation with additive is lower than its corresponding control example, and that the modulus with additive is greater than its corresponding control example.

It is believed that at least four characteristics are always changed in the same direction (with respect to a control example) through the use of these additives. These characteristics are: elongation, modulus, washfastness, and package relaxation. Elongation decreases with additives, modulus increases with additives, washfastness increases with additives, and package relaxation increases with additives.

Table III illustrates the improved washfastness for several examples given in Table I. In Table III a control example was run by spinning a B300 chip without additives, the resulting filaments being drawn at a draw ratio of 1.05, the filaments then being wound at a speed of 4750 meters per minute, just as in Examples 1, 5 and 10. The product was knitted into a hoseleg, which was then cut into two pieces, each piece of which was then dyed. One piece was dyed in Kiton fast Blue (C.I. Acid Blue 45) dye, the other in Celanthrene fast Blue CR (C.I. Disperse Blue 7) dye. Each piece was then washed five times in a conventional washing machine. The hoselegs had ΔE measurements (CIELAB) taken before and after washing. A ΔE value was determined for each of the pieces. The same process was undertaken for several examples listed above. Table III below gives the results of these tests for washfastness

TABLE III

| SAMPLE NUMBER | IMPROVED EYE WASHFASTNESS AFTER 5 MACHINE WASHINGS: KITON ACID DYE ΔE CIELAB NORMALIZED TO CONTROL SAMPLE | CELANTHRENE DISPERSE DYE ΔE CIELAB NORMALIZED TO CONTROL SAMPLE | ORTOLON PREMETALLIZED DYE ΔE CIELAB NORMALIZED TO CONTROL SAMPLE |
|---|---|---|---|
| 14 (CONTROL) | 1.00 | 1.00 | |
| 15 | 1.39 | 1.32 | |
| 16 | 1.41 | 1.31 | |
| 17 | 1.69 | 1.24 | |
| 18 | 1.52 | 1.47 | |
| 19 | 1.10 | 1.33 | |
| 20 | 1.61 | 1.53 | |
| 31(CONTROL) | 1.00 | 1.00 | 1.00 |
| 32 | 1.18 | 1.26 | 2.88 |
| 33(CONTROL) | 1.00 | 1.00 | 1.00 |
| 34 | 1.05 | 1.17 | 1.16 |

The E values have been normalized with respect to the control sample in order to make comparisons easy. In samples 31 through 34, an Ortolon Blue G (C.I. Acid Blue 151) dye was used in addition to Kiton and Celanthrene. As can be seen from the data in Table III, the washfastness of the fabrics made using yarns containing additives was always superior to the washfastness of the fabrics made using yarns which were made without additives.

Examples 1 through 86 were carried out using the preferred high speed spin-draw-wind process described above. These examples illustrate a variety of conditions with respect to spinning speeds, draw ratio, additive amount, additive type, polyamide polymer characteristics (see Table II), and yarn type. For each set of conditions, the resulting: (a) relative viscosity (RV) of the melt mix; (b) percent elongation of the product; and (c) breaking load at 10% elongation (L-10) were given. The examples are shown in "sets" (i.e. Examples 1–4, 5–9, 10–20, etc.), in which a given polymer type was spun with a given additive, the filaments then being drawn at a fixed draw ratio, and wound at a fixed speed, while the amount of additive was varied. Control examples (using no additive, i.e. pure polymer) were run for each set of conditions, the control runs being the first run of each set shown in Examples 1–86. In the "Filament Type" column, the first number represents the total denier and the second number represents the number of filaments, while the R represents a round cross-section and the T represents a trilobal cross-section.

The most significant result from Examples 1–86 is the unexpected effect that increasing the amount of additive had on the product elongation: As RV dropped due to increasing amount of additive added, percent elongation surprisingly also dropped. To one of skill in the art, a drop in RV would normally be expected to create a gain in the percent elongation of the product, all other factors remaining the same. In fact, RV and percent elongation are inversely proportional in low speed processes, as is discussed below. In Examples 1–86, it can be seen that at high speeds, the use of an additive consistently lowered both the RV of the polymer mix and the resulting elongation of the product, as compared with the control run. This result was found for all five polyamide polymer chip types investigated, and all seven additives investigated. Furthermore, this effect was substantiated at draw ratios of 1.00, 1.05, 1.07, 1.13, 1.14, 1.20, 1.30 and 1.45, and at winder speeds of 4,000, 4,300, 4,750, 5,000, 5,250, and 5,660 meters per minute. In addition, Examples 1–86 show that the L-10 is almost always higher through use of an additive. In Examples 1–86, it was not always found that the addition of "more additive" caused a FURTHER decrease in elongation, and/or FURTHER increased L-10, but it was found that the addition of "more additive" always created a further lowering of the RV. However, the addition of "more additive" always resulted in an RV lower than the control, a percent elongation lower than the control, and an L-10 higher than the control.

The unusual, unexpected result found in Examples 1–86 is the fact that the use of a low viscosity, low molecular weight additive lowered the elongation of the resulting product. It would normally be expected that the use of such an additive would raise the elongation of the product. In fact, this second situation turns out to be true, specifically in the classical 2-stage production process, as shown below in Table V.

TABLE V

USE OF ADDITIVES IN A CLASSICAL 2-STAGE PROCESS (i.e. spin lug draw)

| EXAMPLE NUMBER | % $H_2O$ | RV | AMINO END GROUPS (meq/kg) | CARBOXYL END GROUPS (meq/Kg) | % EXTRACT IN MeOH | SPINNING SPEED (M/MIN) | DRAW* RATIO (%) | ELONGATION (%) | L-10 BREAKING LOAD 10% ELONG. (gm) | NORMALIZED ΔE CIELAB FOR KITON DYE AFTER ONE WASHING |
|---|---|---|---|---|---|---|---|---|---|---|
| 87 | 0 (Control) | 2.80 | 32.1 | 54.3 | 1.58 | 800 | 2.70 | 46.8 ± 5.7 | 108 ± 13 | 1.00 |
| 88 | 0.37 | 2.75 | 33.1 | 54.4 | 1.65 | 800 | 2.70 | 50.4 ± 4.6 | 100 ± 11 | 1.02 |
| 89 | 0.74 | 2.67 | 35.1 | 55.4 | 1.81 | 800 | 2.70 | 54.9 ± 2.1 | 100 ± 3 | 0.92 |
| 90 | 1.48 | 2.50 | 43.4 | 65.0 | 1.91 | 800 | 2.70 | 61.8 ± 4.8 | 84 ± 1 | 0.88 |
| 91 | 2.21 | 2.34 | 48.7 | 70.0 | 1.76 | 800 | 2.70 | 61.2 ± 7.7 | 77 ± 4 | 0.91 |
| 92 | 2.95 | 2.33 | 51.3 | 72.2 | 1.80 | 800 | 2.70 | 67.8 ± 8.0 | 75 ± 2 | 0.92 |

*Draw ratio set to yield approximately 50% elongation for the control example (87).

Thus, the advantage of the additives described herein is limited to high production speeds, as recited in the claims. It therefore becomes apparent that another unexpected element is found in the present invention: the combination of the additive together with the requirement of high speed process operation. Table V illustrates how product elongation rises with the use of an additive, compared with the identical process conditions without the use of additives.

For purposes of the present invention, the term "additive" is herein defined to include only substances having a molecular weight of less than 400, these substances having a melting point below the temperature at which melt spinning is carried out. Furthermore, the additives must be within the group consisting of water, alcohols, and organic acids. Water is considered to be the most preferred additive. If water is the additive, the water must be present in the mix in an amount which is greater than 0.15% by weight. This is because the polyamide polymers spun at high speed in the prior art occasionally contain some moisture, often by accident, and this moisture is believed always to have been less than 0.15%, thus the scope of the present invention has been limited to specifically avoid overlap with this accidental prior art which was considered undesirable heretofore.

It has been found that the mixing of the additive into the polymer must result in a uniform mix, or the product will not have sufficient uniformity of characteristics, i.e. yarn properties will vary undesirably, as well as yarn processability. In order to insure adequate mixing, 26 4×4 motionless, continuous Interfacial Surface Generator mixers were installed in the pipe leading from the extruder to the spinnerette, these ISG's being used in Examples 1 through 86. These mixers are described fully in U.S. Pat. No. 3,583,678, which is herein incorporated by reference. Mixers identical to those utilized in the Examples herein, can be obtained from Charles Ross & Son Co., 710–718 Old Willets Path, Hauppauge, Long Island, N.Y. 11787. Table IV below illustrates the need to adequately mix the additive with the polymer. Without adequate blending of the polymer with the additive, yarn chemical properties will vary undesirably from threadline to threadline, as will yarn processability.

TABLE IV

| | without mixers | with 26 4 × Ross Ross ISG's |
|---|---|---|
| RV range | 0.08 | 0.01 |
| Amino End Group Range (meq/kg) | 2.5 | 0.3 |
| Kiton Dye Junction* Range | 5 | 0–1 |
| Warping Defects per Million End Yarns | 280 | <0.3 |

*A dye junction is the minimal visual difference in dye depth discernable to the human eye.

Table IV shows that RV range, amino end group range, Kiton dye junction range, and warping defects vary considerably more, and to an undesirable degree, without mixing as opposed to with mixing using 26 static mixers.

The use of the additives of the present invention may provide a variety of benefits in addition to elongation and L-10. For example, package deformation may be decreased through the use of additives. The yarn made in Example 58 was wound onto a bobbin for a period of two hours. The package could be readily removed from the chuck. This indicates that even at high draw ratios and relatively high winder speeds, the additive can allow one to produce a product which has very little internal stress when compared to an identical process without additive use. It is believed that if the process of example 58 was carried out without additive, the bobbin would not have been removable from the chuck, all other conditions being the same.

Examples 62 through 69 demonstrate the effect of additive on reduction of internal package stress. During this series of Examples, the winder speed remained constant while the speed of both godets (20 and 21) was reduced in order to maintain constant yarn tension between the second godet and the winder. In Example 69, in which 1.5% water was added, the godet speed could not be slowed enough to keep the yarn from falling off of the bobbin, as the yarn was actually expanding as it was being wound onto the bobbin. In fact, the godets were slowed until a 15–20 gram tension was applied to the yarn between the second godet and the winder (compared with 6 grams of yarn tension used in Examples 62–65), and still the yarn expanded off the bobbin.

Figure 2:
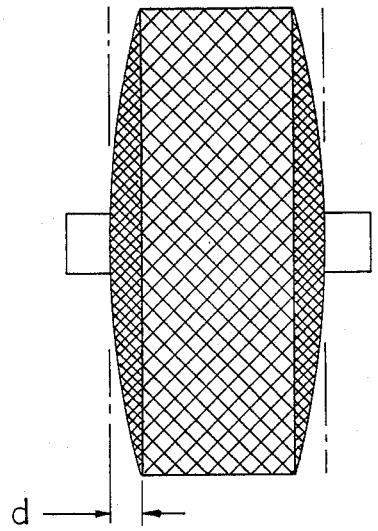
FIG. 2 illustrates package "side bulge deformation" (d).
Figure 3:
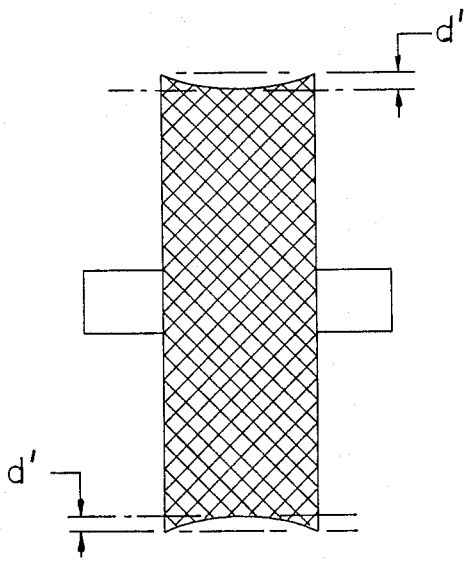
FIG. 3 illustrates "concave top deformation" (d').

Actual package deformation is created by yarn shrinkage on the bobbin. Shrinkage of yarn on the bobbin creates a "side bulge" deformation and a "concave top" deformation to the bobbin, and if shrinkage is large enough, tube crushing may also occur. Package deformation has been reduced through the use of additives. FIG. 2 illustrates package "side bulge deformation" (d) while FIG. 3 illustrates "concave top deformation" (d'). In reality, a deformed package contains both types of deformation simultaneously.

Figure 4:
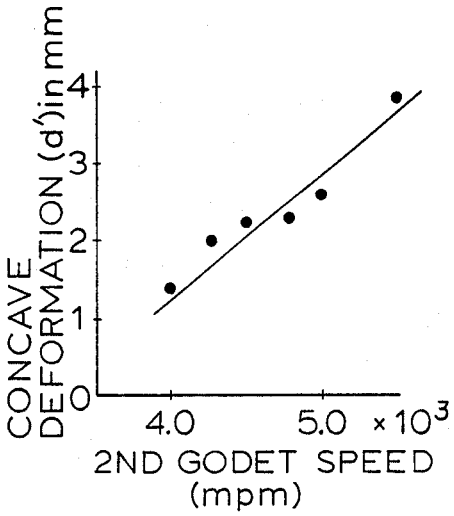
FIG. 4 illustrates the effect of increasing the speed of the godets on the amount of concave top deformation, this process being carried out without the use of an additive.
Figure 5:
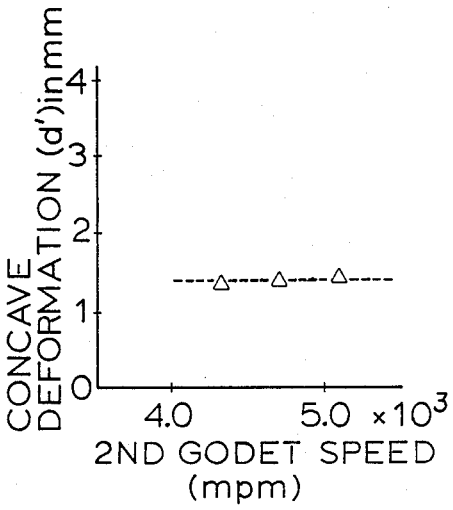
FIG. 5 illustrates the same situation except that 0.75% water was added to the polymer.
Figure 6:
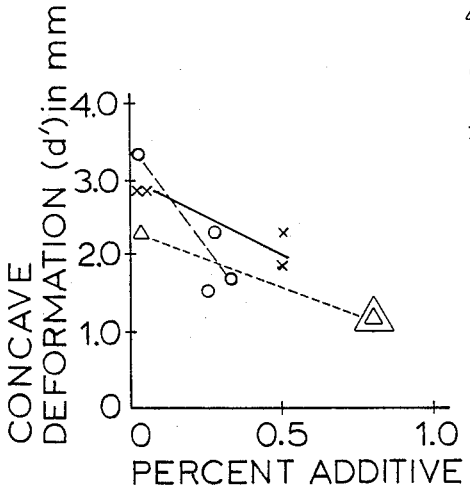
FIG. 6 illustrates how increasing the percent additive creates a decrease in the concave top deformation for the high speed process described herein.

FIG. 4 illustrates the effect of increasing the speed of the godets (20 and 21) on the amount of concave top deformation, this process being carried out without the use of an additive. As can be seen from the upward slope of the line of FIG. 4, the amount of "concave top" package deformation increases linearly between godet speeds of 4,000 and 5,000 meters per minute, if additives are not employed. FIG. 5 illustrates the same situation, except that 0.75% water was added to the polymer immediately before the extruder, the additive then being mixed thoroughly with the polymer. FIG. 5 indicates that the use of water effectively eliminated any INCREASE in the "concave top" package deformation between speeds of 4,000 and 5,000 meters per minute. The runs performed in FIGS. 4 and 5 utilized B300 polymer, a draw ratio of 1.00, and produced a 40 denier 12 filament product. FIG. 6 illustrates how increasing the percent additive creates a decrease in the concave top deformation for the high speed process described herein.

Figure 7:
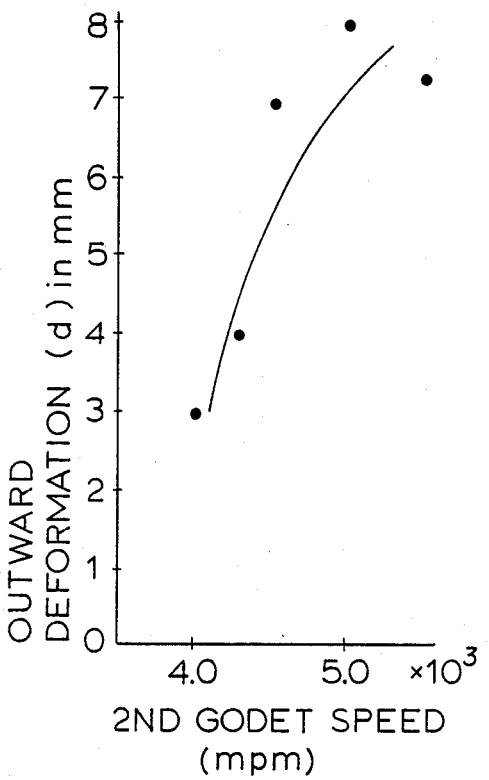
FIG. 7 illustrates the effect of godet speed on "side bulge" package deformation.
Figure 8:
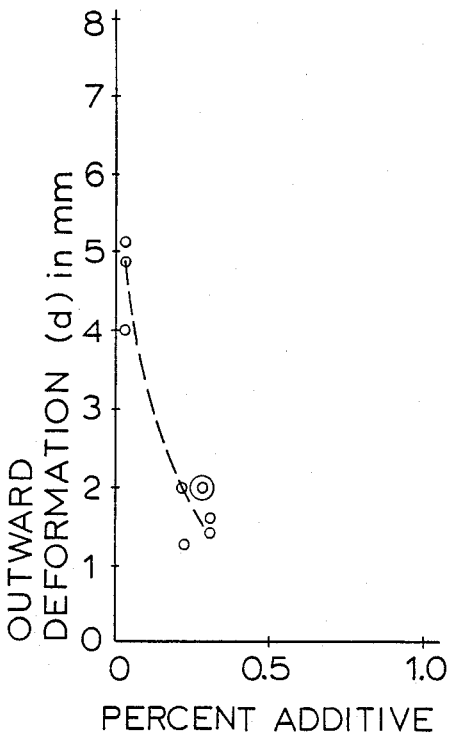
FIG. 8 illustrates the effect of additives on "side bulge" deformation.

FIG. 7 illustrates the effect of godet speed on "side bulge" package deformation (d, as shown in FIG. 2), this figure indicating that as the speed of the godets is increased from 4,000 to 5,000 meters per minute, the "side bulge" package deformation increases sharply from 3 millimeters to 7.5 millimeters. The process runs indicated by FIG. 7 were performed without additives. FIG. 8 illustrates the effect of additives on "side bulge" deformation. As additive (in this example, water) concentration increased, side bulge deformation decreased sharply. The process runs of FIG. 7 utilized B300 chip, a draw ratio of 1.00, and produced a 40 denier, 12 filament yarn. The process runs of FIG. 8 utilized B216 chip, a draw ratio of 1.00, and produced a 40 denier, 12 filament yarn, at the takeup speed of 5000 meters per minute.

The particular winder used to build a package is also related to package deformation. When using either a Barmag SW46SSD/4 or a Reiter J7/H4 winder, at a constant winder setting (dependent upon the speed to give a constant helix angle), large packages of 40 denier 12 filament yarns were made and measured for changes in top curvature and side deformation of the yarn package in millimeters. It was found that without additives the concave top curvature and outward side deformation increased as the winder speed increased (denier remaining constant). However, with the addition of an additive the deformations decreased in proportion to the amount of additive. Also, unexpectedly, when 0.75% water was added to polyamide under the conditions illustrated in FIG. 5, an increase in speed created no substantial increased in package deformation. This phenomenon is considered to be of great importance, as the use of additives may make higher production speeds possible, without tube crushing or undesirable package deformation levels, without the addition of heat relaxation devices.

Another benefit from the use of the additives of the present invention is found in the dye uniformity of fabrics made from the yarn which was produced using additives. Fiber was produced by adding 0.5% $H_2O$ to B216 chip. The filaments were produced by the process illustrated in FIG. 1, on which apparatus the filaments were drawn 1.14x and wound up at 5000 meters per minute. The yarn produced was a 40/12 dull yarn (i.e. the yarn contained titanium dioxide). The yarn was used to make a single bar tricot fabric. The fabric was then dyed with an acid dye, a disperse dye, and a premetallized dye. The fabric was visually rated for dye uniformity on a scale of 1 to 7, where 1 represents the highest quality of dye uniformity—i.e. no visible nonuniformities. All of the dyed samples rated at 2. Other fabrics were produced from yarns manufactured without additives but on the same apparatus. None of these other fabrics rated as highly as 2 for all three types of dyes used.

The use of additives as described herein has enabled large packages to be made consistently at high speed. For example, a B300 chip (RV=2.8) was used to produce 128 large packages of yarn. The polymer had 2% water added, with the resulting uniform mix being extruded into filaments. The process was carried out by the apparatus of FIG. 1. The filaments were drawn 1.04x between the godets, and were then wound at 5100 meters per minute. The yarn produced was a 40 denier, 12 filament bright, triangular cross-section yarn, having an elongation of 50%. Four six-hour doffs were made each day for each of 2 machines which were operated over a four day period, resulting in 128 packages of yarn, as each machine produced 4 packages simultaneously. The full package yield was over 96%, and the warping performance was under 0.2 defects per million end yards.

The use of the process of the present invention may also provide a method of making a very uniform product. For example, a B216 chip having 0.5% water mixed uniformly therewith was spun (by the apparatus of FIG. 1) into a 40/12 yarn. The filaments were drawn 1.14x and wound at 5000 meters per minute. The yarn was then warp knitted, and exhibited only 0.27 defects per million end yards. The yarn had the following characteristics: % elongation of 50.0±2.0; L-10 of 57.8±1.8 grams; denier of 40.0±0.18; breaking load of 169±4.5 grams; entanglement level of 19.0±2.0 nodes per meter; Kiton (acid dye C.I. 45) dye junction of ±0.66; Celanthrene (C.I. Disperse Blue 7) dye junction of ±0.48. Table VI below illustrates the uniformity of chemical properties for three trial process runs using additives.

Birefringence measurements were taken on conditioned round filaments which had been mounted in a Leitz Universal Research microscope, Model Orthoplan (with a polarizer and rotating analyzer). Retardation was measured by a Berek tilting compensator.

Sonic Modulus measurements were taken on conditioned samples, using a Dynamic Modulus Tester model PPM-5R, manufactured by the H. M. Morgan Company, Inc. The slope from 5 curves were averaged, an the resulting modulus ($N/m^2 \times 10^9$) was adjusted to a conditioned RH of 22%.

Density measurements were taken using calibrated density gradient columns of tetrachloroethylene and heptane. Measurements were not corrected for additive or monomer.

In order to determine percent crystallinity and $f_c$, x-ray measurements were taken on a Siemens D-500 x-ray Diffraction unit, which was interfaced to a HP85 computer. Crystalline orientation functions were determined from x-ray azimuthal scans. Crystallinity values were determined from the relative percent of alpha crystal structure from x-ray together with the density measurements.

The amorphous orientation function ($f_a B_{ir}$) was determined from the birefringence data using 0.069 as the intrinsic birefringence for both the crystalline and amorphous phases according to the following equations:

$$\text{where: } \Delta n = \beta f_c \Delta n_c^o + (1-\beta) f_a \Delta n_a^o$$

$\Delta n$ = measured birefringence

TABLE VI

| UNIFORMITY OF DRY YARN CHEMICAL PROPERTIES | | | | | |
|---|---|---|---|---|---|
| ADDITIVE TYPE | AMOUNT | CHIP TYPE | RV | YARN CHEMICAL PROPERTIES AMINO END GROUPS (Meg/kg) | METHANOL EXTRACTABLES (%) |
| $H_2O$ | 1.5% | B300 | 2.46 ± .01 | 44.5 ± 0.3 | 1.65 ± 0.8 |
| Triethylene- | 3.0% | B300 | 2.45 ± .01 | 42.9 ± 0.2 | 2.81 ± 0.14 |
| $H_2O$ | 0.5% | B216 | 2.28 ± .01 | 36.5 ± 0.4 | 1.45 ± 0.24 |

As can be seen on Table VI, all three runs produced yarn having a high degree of chemical uniformity. These samples were collected periodicly throughout each of the three trials.

Table VII below provides one explanation for many of the above-described advantages of the present invention.

$\beta$ = percent crystallinity
$f_c$ = crystalline orientation
$\Delta n_a^o$ = intrinsic birefringence for the crystalline phase
$\Delta n_a^o$ = intrinsic birefringence for the amorphous phase In order to determine the crystalline size, equitorial

TABLE VII

| POLYMER ORIENTATION | | | | | | | | |
|---|---|---|---|---|---|---|---|---|
| EXAMPLE NO. | BIREFRINGENCE | SONIC MODULUS ($N/m^2 \times 10^9$) | DENSITY (g/cc) | % XTAL | $F_c$ | $F_a$ Bir | SIZE EQUITORIAL (A) | % $\gamma$ |
| 10 (control) | 0.0346 | 4.65 | 1.1285 | 46 | 0.86 | 0.20 | 56.1 | 91 |
| 15 | 0.0358 | 4.78 | 1.1300 | 48 | 0.87 | 0.20 | 49.7 | 100 |
| 16 | 0.0377 | 4.80 | 1.1285 | 46 | 0.86 | 0.28 | 43.1 | 89 |
| 51(control) | 0.0368 | 4.42 | 1.1305 | 51 | 0.82 | 0.24 | 32 | 75 |
| 52 | 0.0381 | | 1.1305 | 51 | | 0.28 | 31 | 75 |
| 53 | 0.0384 | | 1.1310 | 50 | | 0.30 | 30 | 70 |
| 54 | 0.0394 | | 1.1315 | 50 | | 0.32 | 29 | 69 |

Table VII indicates that the use of additives enables a higher degree of polymer orientation. This is verified by several different measurements which are directly related to the degree of polymer orientation (e.g. birefringence, sonic moduli, amorphous orientation, gamma crystal size, etc.).

x-ray diffraction peak widths at half peak height were used to estimate the gamma crystalline size.

I claim:

1. A high-speed melt spinning process of preparing polyamide filaments with decreased elongation and increased breaking strength comprising:

(a) admixing a sufficient amount of an additive having a molecular weight less than 400 and selected from the group consisting of water, an alcohol, and an organic acid with a melt-spinnable polyamide to form a homogeneous polyamide-additive mixture so that upon extrusion of said polyamide-additive mixture said polyamide has a relative viscosity in the range of from about 2.0 to about 3.0;

(b) melt-extruding said homogeneous polyamide-additive mixture through a spinnerette to form said polyamide filaments;

(c) quenching said polyamide filaments;

(d) drawing the quenched polyamide filaments; and, (e) taking up said polyamide filaments at a speed greater than 4,000 meters per minute.

2. The process recited in claim 1 wherein said amount of said additive is an amount greater than 0.5 percent by weight of said polyamide-additive mixture.

3. The process recited in claim 2 wherein said additive is selected from the group consisting of water, benzyl alcohol, triethyleneglycol, pentaerythritol, benzoin, chlorobenzoic acid, and lauric acid.

4. The process recited in claim 3 wherein the resulting filaments have a denier per filament of less than 12.

5. The process recited in claim 4 wherein the filaments have a denier per filament of less than 3.5.

6. The process recited in claim 5 wherein the additive is water and the polymer is polycaprolactam.

7. The process recited in claim 6 wherein said relative viscosity is in the range of from about 2.2 to about 2.6.

8. The process recited in claim 1 wherein said drawing is carried out at a draw ratio in the range of from about 1.02 to about 3.0.

9. The process recited in claim 3 wherein said drawing is carried out at a draw ratio in the range of from about 1.02 to about 1.45.

* * * * *